US010316668B2

(12) United States Patent
Blake et al.

(10) Patent No.: US 10,316,668 B2
(45) Date of Patent: Jun. 11, 2019

(54) GAS TURBINE ENGINE COMPONENT HAVING CURVED TURBULATOR

(71) Applicant: UNITED TECHNOLOGIES CORPORATION, Hartford, CT (US)

(72) Inventors: Mosheshe Camara-Khary Blake, Manchester, CT (US); Lisa K. Osborne, Manchester, CT (US); Thomas N. Slavens, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 684 days.

(21) Appl. No.: 14/765,390

(22) PCT Filed: Jan. 31, 2014

(86) PCT No.: PCT/US2014/013981
§ 371 (c)(1),
(2) Date: Aug. 3, 2015

(87) PCT Pub. No.: WO2014/175937
PCT Pub. Date: Oct. 30, 2014

(65) Prior Publication Data

US 2015/0377029 A1 Dec. 31, 2015

Related U.S. Application Data

(60) Provisional application No. 61/760,795, filed on Feb. 5, 2013.

(51) Int. Cl.
*F01D 5/14* (2006.01)
*F01D 5/18* (2006.01)
(Continued)

(52) U.S. Cl.
CPC ..... *F01D 5/141* (2013.01); *F01D 5/18* (2013.01); *F01D 5/181* (2013.01); *F01D 5/187* (2013.01);
(Continued)

(58) Field of Classification Search
CPC ..... F01D 25/08; F01D 5/141; F01D 5/18; F01D 5/181; F01D 5/187; F01D 9/065;
(Continued)

(56) References Cited

U.S. PATENT DOCUMENTS 4,514,144 A 4/1985 Lee
5,232,343 A 8/1993 Butts
(Continued)

FOREIGN PATENT DOCUMENTS

EP 1607577 A2 12/2005
EP 1944469 A2 7/2008
EP 2230384 A2 9/2010

OTHER PUBLICATIONS

International Preliminary Report on Patentability for International application No. PCT/US2014/013981 dated Aug. 20, 2015.
(Continued)

*Primary Examiner* — Mark A Laurenzi
*Assistant Examiner* — Mickey H France
(74) *Attorney, Agent, or Firm* — Carlson, Gaskey & Olds, P.C.

(57) ABSTRACT

A component for a gas turbine engine according to an exemplary aspect of the present disclosure includes, among other things, a wall that forms a portion of an outer periphery of at least one cavity and at least one curved turbulator that extends from said wall.

20 Claims, 4 Drawing Sheets

(51) Int. Cl.
*F01D 9/06* (2006.01)
*F01D 25/08* (2006.01)

(52) U.S. Cl.
CPC ..... *F01D 9/065* (2013.01); *F01D 25/08* (2013.01); *F05D 2240/11* (2013.01); *F05D 2240/127* (2013.01); *F05D 2250/71* (2013.01); *F05D 2260/2212* (2013.01); *F05D 2260/22141* (2013.01)

(58) Field of Classification Search
CPC ..... F05D 2240/11; F05D 2240/127; F05D 2250/71; F05D 2260/2212; F05D 2260/22141
USPC ..... 415/208.1; 416/95, 232
See application file for complete search history.

(56) References Cited

U.S. PATENT DOCUMENTS 5,797,726 A 8/1998 Lee
5,967,752 A 10/1999 Lee et al.
5,971,708 A 10/1999 Lee
6,068,445 A 5/2000 Beeck et al.
6,224,336 B1 5/2001 Kercher
6,331,098 B1 12/2001 Lee
6,357,999 B1 3/2002 Pearce et al.
6,554,571 B1 4/2003 Lee et al.
6,641,362 B1 * 11/2003 Anding ..... F01D 5/187 415/115
7,637,720 B1 12/2009 Liang
7,753,650 B1 7/2010 Liang
7,785,071 B1 8/2010 Liang
2005/0281673 A1 * 12/2005 Draper ..... B23P 15/02 416/97 R
2006/0171808 A1 8/2006 Liang
2007/0224048 A1 * 9/2007 Abdel-Messeh ..... F01D 5/187 416/97 R
2008/0107519 A1 5/2008 Ahmad
2009/0074575 A1 3/2009 Propheter-Hinckley et al.
2009/0317234 A1 12/2009 Zausner et al.
2010/0124483 A1 * 5/2010 Weaver ..... F01D 5/082 415/115
2011/0033312 A1 * 2/2011 Lee ..... F01D 5/187 416/97 R
2012/0063916 A1 * 3/2012 Boyer ..... F01D 5/187 416/97 R

OTHER PUBLICATIONS

International Search Report and Written Opinion of the International Searching Authority for International application No. PCT/US2014/013981 dated Nov. 10, 2014.
The Extended European Search Report for EP Application No. 14787682.5, dated Nov. 22, 2016.

* cited by examiner

GAS TURBINE ENGINE COMPONENT HAVING CURVED TURBULATOR

BACKGROUND

This disclosure relates to a gas turbine engine, and more particularly to a gas turbine engine component that includes at least one curved turbulator.

Gas turbine engines typically include a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

Due to exposure to hot combustion gases, numerous components of the gas turbine engine may include internal cooling passages that route cooling air through the part. A variety of interior treatments may be incorporated into the internal cooling passages to augment the heat transfer effect and improve cooling. For example, some cooling passages may include pedestals, air-jet impingement, or turbulator treatments.

SUMMARY

A component for a gas turbine engine according to an exemplary aspect of the present disclosure includes, among other things, a wall that forms a portion of an outer periphery of at least one cavity and at least one curved turbulator that extends from said wall.

In a further non-limiting embodiment of the foregoing component for a gas turbine engine, the component is one of a blade and a vane.

In a further non-limiting embodiment of either of the foregoing components for a gas turbine engine, the component is a blade outer air seal (BOAS).

In a further non-limiting embodiment of any of the foregoing components for a gas turbine engine, a plurality of curved turbulators are spaced along the wall.

In a further non-limiting embodiment of any of the foregoing components for a gas turbine engine, the at least one curved turbulator includes a contiguous body having at least one peak and at least one valley.

In a further non-limiting embodiment of any of the foregoing components for a gas turbine engine, the contiguous body provides a smooth surface that excludes any sharp transition areas.

In a further non-limiting embodiment of any of the foregoing components for a gas turbine engine, the at least one curved turbulator is sinusoidal shaped.

In a further non-limiting embodiment of any of the foregoing components for a gas turbine engine, a row of film cooling holes are spaced from the at least one curved turbulator.

In a further non-limiting embodiment of any of the foregoing components for a gas turbine engine, the row of film cooling holes includes a first film cooling hole and a second film cooling hole staggered from said first film cooling hole.

In a further non-limiting embodiment of any of the foregoing components for a gas turbine engine, a second turbulator extends from the wall and includes a different shape from the at least one curved turbulator.

In a further non-limiting embodiment of any of the foregoing components for a gas turbine engine, the at least one curved turbulator extends across a width of said wall.

In a further non-limiting embodiment of any of the foregoing components for a gas turbine engine, the at least one curved turbulator extends perpendicular to a direction of flow of cooling airflow communicated through the at least one cavity.

A component for a gas turbine engine according to an exemplary aspect of the present disclosure includes, among other things, a first curved turbulator that protrudes into a cavity flow path and a second curved turbulator that protrudes into the cavity flow path at a position that is spaced from the first curved turbulator. A row of film cooling holes are disposed between the first curved turbulator and the second curved turbulator.

In a further non-limiting embodiment of the foregoing component for a gas turbine engine, the row of film cooling holes includes a first film cooling hole and a second film cooling hole that is staggered from the first film cooling hole.

In a further non-limiting embodiment of either of the foregoing components for a gas turbine engine, the first curved turbulator and the second curved turbulator are sinusoidal shaped.

In a further non-limiting embodiment of any of the foregoing components for a gas turbine engine, a pitch between the first curved turbulator and the second curved turbulator is continuously varied.

Nom A gas turbine engine according to an exemplary aspect of the present disclosure includes, among other things, a compressor section, a combustor section in fluid communication with the compressor section and a turbine section in fluid communication with the combustor section. A component extends into a core flow path of at least one of the compressor section and the turbine section, The component includes a wall that forms a portion of an outer periphery of at least one cavity of the component. At least one curved turbulator extends from the wall.

In a further non-limiting embodiment of the foregoing gas turbine engine, the component is an airfoil of the turbine section.

In a further non-limiting embodiment of either of the foregoing gas turbine engines, the component is a blade outer air seal (BOAS).

In a further non-limiting embodiment of any of the foregoing gas turbine engines, the wall is part of a platform of the component.

The various features and advantages of this disclosure will become apparent to those skilled in the art from the following detailed description. The drawings that accompany the detailed description can be briefly described as follows.

DETAILED DESCRIPTION

Figure 1:
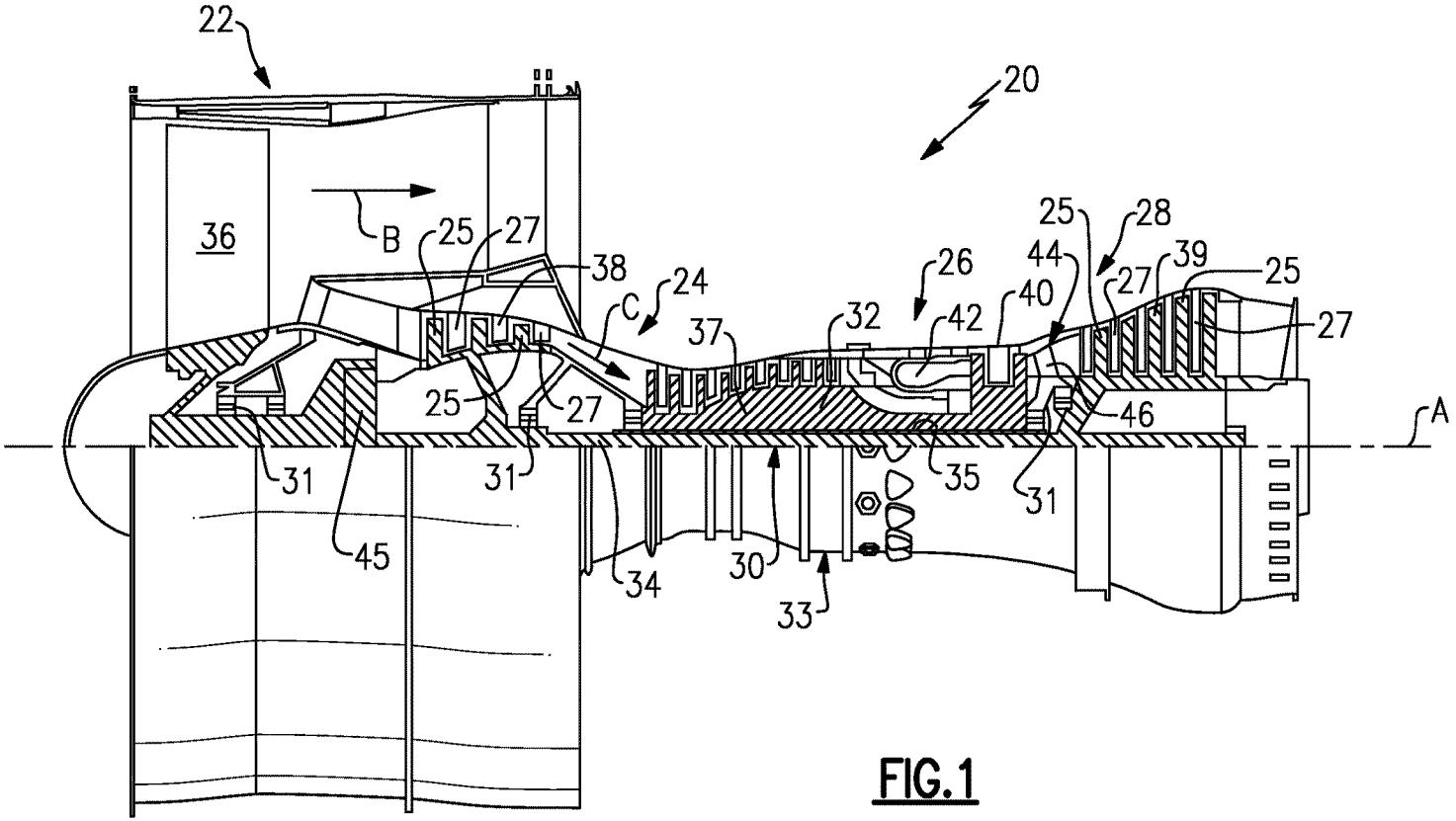
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}^\circ\ \text{R})/(518.7^\circ\ \text{R})]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Various components of the gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation.

This disclosure relates to curved turbulators that can be incorporated into the walls of internal cooling cavities of gas turbine engine components. Among other benefits, the exemplary curved turbulators provide reduced stress concentrations and increased flexibility of film cooling hole placement as compared to prior art interior treatments.

Figure 2:
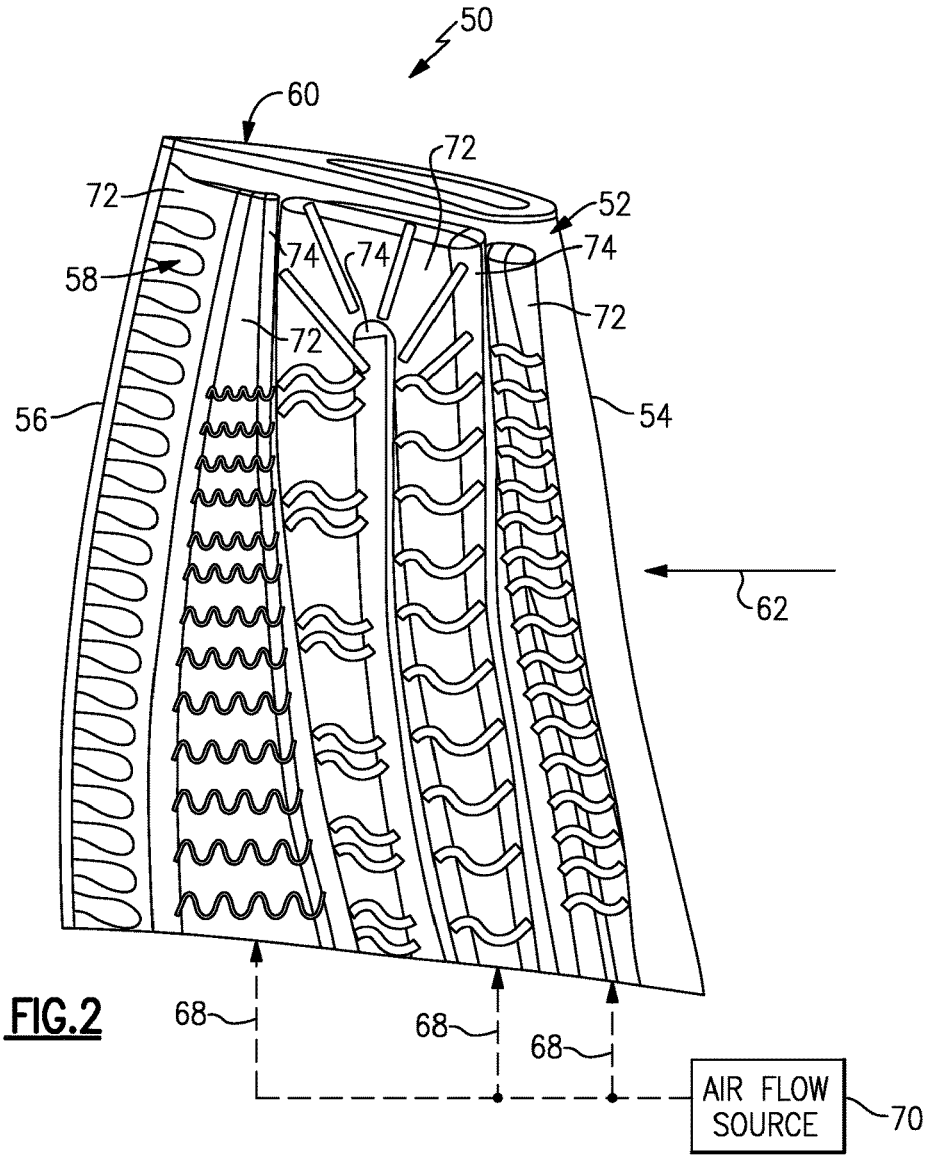
FIG. 2 illustrates a component that can be incorporated into a gas turbine engine.
Figure 3:
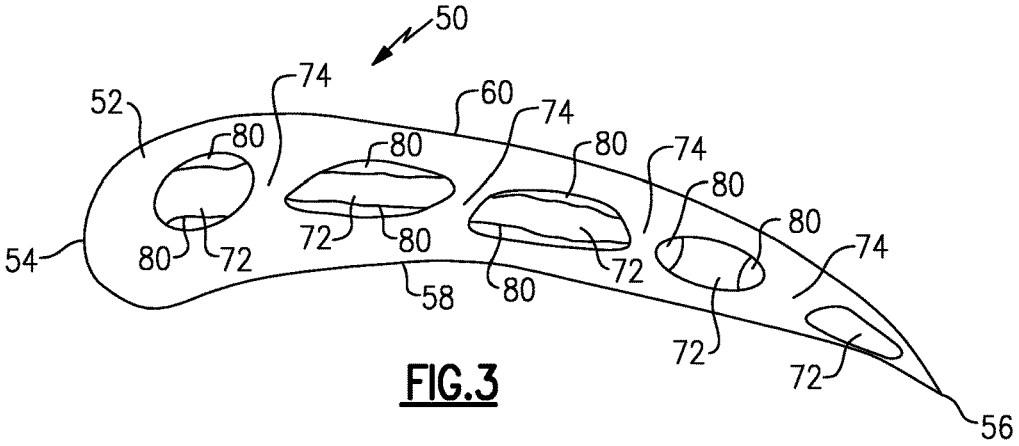
FIG. 3 illustrates a cross-sectional view of the component of FIG. 2.

FIGS. 2 and 3 illustrate a component 50 that can be incorporated into a gas turbine engine, such as the gas turbine engine 20 of FIG. 1. The component 50 may include a body portion 52 that axially extends between a leading edge portion 54 and a trailing edge portion 56. The body portion 52 may additional include a first wall 58 (e.g., a pressure side wall) and a second wall 60 (e.g., a suction side wall) that are spaced apart from one another and that join at each of the leading edge portion 54 and the trailing edge portion 56.

In this embodiment, the body portion 52 is representative of an airfoil. For example, the body portion 52 could be an airfoil that extends between inner and outer platforms (not shown) where the component 50 is a vane, or could extend from platform and root portions (also not shown) where the component 50 is a blade. Alternatively, the component 50 could be a non-airfoil component, including but not limited to a blade outer air seal (BOAS), a combustor liner, a turbine exhaust case liner, or any other part that may require dedicated cooling.

A gas path 62 is communicated axially downstream through the gas turbine engine 20 along the core flow path C (see FIG. 1) in a direction that extends from the leading edge portion 54 toward the trailing edge portion 56 of the body portion 52. The gas path 62 represents the communication of core airflow along the core flow path C.

One or more cavities 72 may be disposed inside of the body portion 52 as part of an internal cooling circuit for cooling portions of the component 50. The cavities 72 may extend radially, axially and/or circumferentially inside of the body portion 52 to establish cooling passages for receiving a cooling airflow 68 to cool the component 50. The cooling airflow 68 may be communicated into one or more of the cavities 72 from an airflow source 70 that is external to the component 50.

The cooling airflow 68 is generally of a lower temperature than the airflow of the gas path 62 that is communicated across the body portion 52. In one particular embodiment, the cooling airflow 68 is a bleed airflow that can be sourced from the compressor section 24 or any other portion of the gas turbine engine 20 that includes a lower temperature and higher pressure than the component 50. The cooling airflow 68 can be circulated through the cavities 72, such as along a serpentine path, to transfer thermal energy from the component 50 to the cooling airflow 68 thereby cooling the component 50. The cooling circuit can include any number of cavities 72. The cavities 72 may be in fluid communication with one another or could alternatively be isolated from one another.

One or more ribs 74 may extend between the first wall 58 and the second wall 60 of the body portion 52. The rib(s) 74 divide the cavities 72 from one another.

As discussed in greater detail below, at least one of the cavities 72 can include one or more curved turbulators 80 that protrude into a cavity flow path 82 of the cavity 72 to disrupt the thermal boundary layer of the cooling airflow 68 and increase the cooling effectiveness of the internal cooling circuit of the component 50. In one embodiment, the curved turbulators 80 are miniature walls protruding into the cavity flow path 82. The design, configuration and placement of the numerous curved turbulators 80 shown by FIGS. 2 and 3 are exemplary only and are not intended to limit this disclosure.

Figure 4:
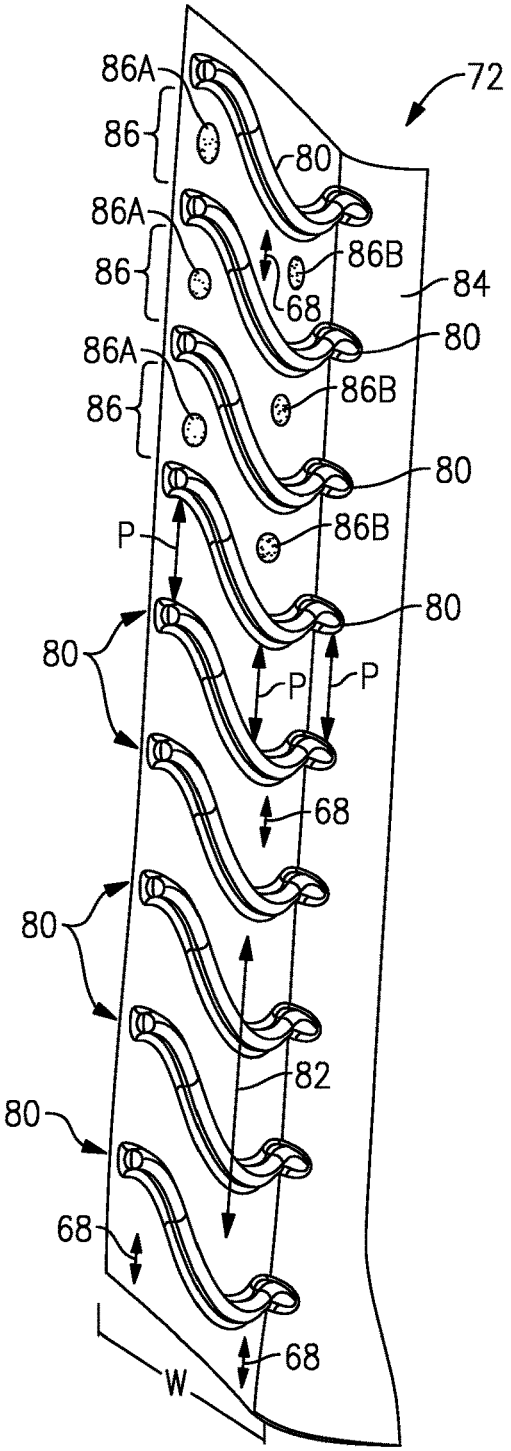
FIG. 4 illustrates a portion of a cooling circuit that can be incorporated into a gas turbine engine.

FIG. 4 illustrates a wall 84 of a cavity 72 of a component (e.g., the component 50). The wall 84 forms a portion of an outer periphery of the cavity 72. The wall 84 could be an internal surface of either the first wall 58 or the second wall 60 (see FIGS. 2 and 3) that faces into the cavity 72, or could extend along one of the ribs 74.

A curved turbulator 80 may extend from the wall 84. In this embodiment, the wall 84 of the cavity 72 includes a plurality of curved turbulators 80. The curved turbulators 80 can span a width W of the wall 84 and extend substantially perpendicular to the direction of flow of the cooling airflow 68 within a cavity flow path 82 of the cavity 72. Due to the continuous curvature of the curved turbulators 80, a pitch P (e.g., a spacing) between each adjacent curved turbulator 80 is continuously varied.

A row of film cooling holes 86 can be disposed between radially adjacent curved turbulators 80. In this embodiment, each row of film cooling holes 86 includes a first film cooling hole 86A and a second film cooling hole 86B that is radially staggered from the first film cooling hole 86A. Of course, additional film cooling holes than are shown in this embodiment could be disposed through the wall 84 in each row of film cooling holes 86. The film cooling holes 86A, 86B do not intersect through any curved turbulator 80 because of the wavy design of the curved turbulators 80. Other portions of the wall 84 may exclude film cooling holes 86 between adjacent curved turbulators 80.

Figure 5:
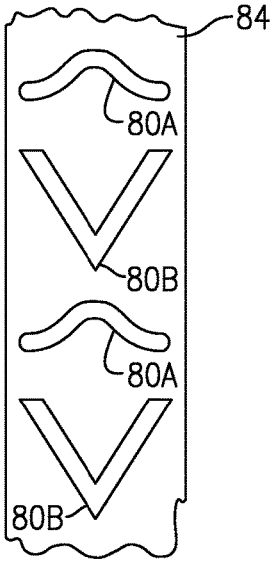
FIG. 5 illustrates another embodiment.
Figure 6:
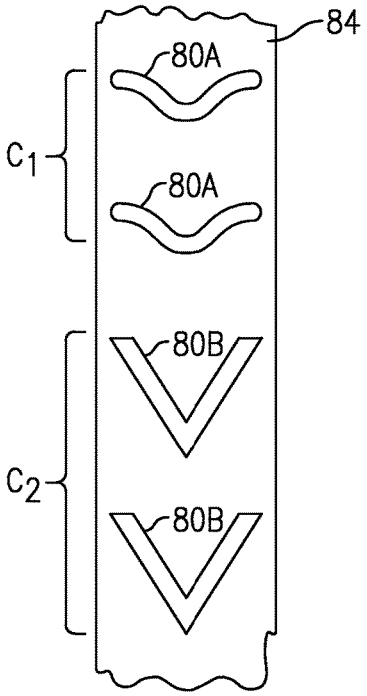
FIG. 6 shows yet another embodiment.

The curved turbulators 80 are configurable in a variety of patterns. For example, as shown in FIG. 4, a plurality of curved turbulators 80 can be radially disposed along the wall 84. In another embodiment, the wall 84 can include a combination of alternating curved turbulators 80A and V-shaped turbulators 80B (see FIG. 5). In yet another embodiment, the wall 84 could include a first cluster C1 of curved turbulators 80A and a second cluster C2 of turbulators 80B embodying a different design than the curved turbulators 80A (see FIG. 6). Other configurations and patterns are also contemplated. The configuration of the various wall treatments can vary based on streamwise profiles, height, spacing, boundary layer shape and other design criteria.

Figure 7A:
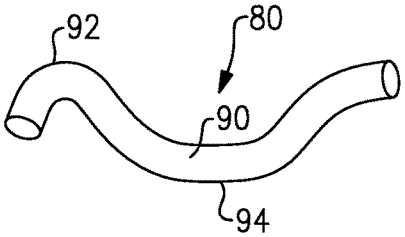
FIGS. 7A and 7B illustrate exemplary turbulators.
Figure 7B:
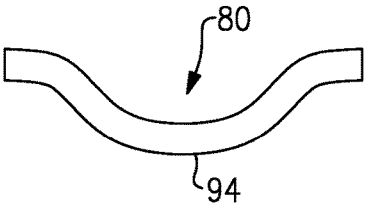

FIG. 7A illustrates one exemplary curved turbulator 80 that can be incorporated into a gas turbine engine component cooling circuit. In this embodiment, the curved turbulator 80 includes a contiguous body 90 that includes at least one peak 92 and at least one valley 94. The contiguous body 90 includes a completely smooth surface that excludes any sharp transition areas. The curved turbulator 80 could also exclude any peak 92 (see FIG. 7B).

Figure 8:
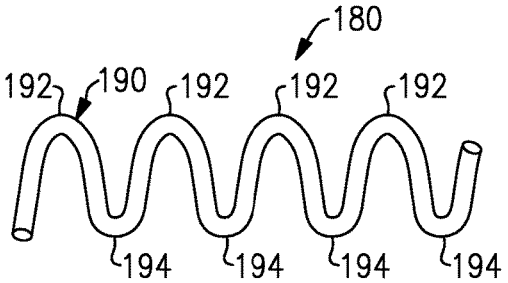
FIG. 8 illustrates another turbulator embodiment.

FIG. 8 illustrates another curved turbulator 180. The curved turbulator 180 of this embodiment is sinusoidal shaped. The curved turbulator 180 may include a plurality of peaks 192 and a plurality of valleys 194 extending along a smooth, contiguous body 190.

The curved turbulators of this disclosure may embody any curved or wavy geometry that provides a smooth transition surface that is capable of accommodating relatively large variations in the streamwise positioning of the turbulators relative to the cooling airflow that flows within the cavities. The exemplary curved turbulators also provide reduced stress concentrations as compared to treatments having more angular designs, such as V-shaped turbulators.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A component for a gas turbine engine, comprising:

a first wall that forms a portion of an outer periphery of at least one cavity;

at least one curved turbulator that extends from said first wall in a first direction and into a cavity flow path of said at least one cavity, said cavity flow path defined between said first wall and a second, opposed wall, and said at least one curved turbulator spaced apart from said second wall such that said cavity flow path extends over said at least one curved turbulator; and wherein said at least one curved turbulator includes a contiguous body having at least one peak and at least one valley in a longitudinal second direction.

2. The component as recited in claim 1, wherein said component is one of a blade and a vane.

3. The component as recited in claim 1, wherein said component is a blade outer air seal (BOAS).

4. The component as recited in claim 1, comprising a plurality of curved turbulators spaced along said first wall.

5. The component as recited in claim 1, wherein said contiguous body provides a smooth surface that excludes any sharp transition areas.

6. The component as recited in claim 1, wherein said at least one curved turbulator is sinusoidal shaped.

7. The component as recited in claim 1, comprising a row of film cooling holes spaced from said at least one curved turbulator.

8. The component as recited in claim 7, wherein said row of film cooling holes includes a first film cooling hole and a second film cooling hole staggered from said first film cooling hole.

9. The component as recited in claim 1, comprising a second turbulator that extends from said first wall and includes a different shape from said at least one curved turbulator.

10. The component as recited in claim 1, wherein said at least one curved turbulator extends across a width of said first wall.

11. The component as recited in claim 1, wherein said at least one curved turbulator extends perpendicular to a direction of flow of cooling airflow communicated through said at least one cavity.

12. A component for a gas turbine engine, comprising:

a first curved turbulator that protrudes from a first wall in a first direction and into a cavity flow path, said cavity flow path defined between said first wall and a second, opposed wall, and said first curved turbulator spaced apart from said second wall such that said cavity flow path extends over said first curved turbulator;

a second curved turbulator that protrudes from said first wall in a first direction and into said cavity flow path at a position that is spaced from said first curved turbulator, and said second curved turbulator spaced apart from said second wall such that said cavity flow path extends over said second curved turbulator;

a row of film cooling holes disposed between said first curved turbulator and said second curved turbulator; and wherein each of said first curved turbulator and second curved turbulator includes a contiguous body having at least one peak and at least one valley in a longitudinal second direction.

13. The component as recited in claim 12, wherein said row of film cooling holes includes a first film cooling hole and a second film cooling hole that is staggered from said first film cooling hole.

14. The component as recited in claim 12, wherein said first curved turbulator and said second curved turbulator are sinusoidal shaped.

15. The component as recited in claim 12, wherein a pitch between said first curved turbulator and said second curved turbulator is continuously varied.

16. A gas turbine engine, comprising:

a compressor section;

a combustor section in fluid communication with said compressor section;

a turbine section in fluid communication said combustor section;

a component that extends into a core flow path of at least one of said compressor section and said turbine section, wherein said component includes:

a first wall that forms a portion of an outer periphery of at least one cavity of said component;

at least one curved turbulator that extends from said first wall in a first direction and into a cavity flow path of said at least one cavity, said cavity flow path defined between said first wall and a second, opposed wall, and said at least one curved turbulator spaced apart from said second wall such that said cavity flow path extends over said at least one curved turbulator; and wherein said at least one curved turbulator includes a contiguous body having at least one peak and at least one valley in a longitudinal second direction.

17. The gas turbine engine as recited in claim 16, wherein said component is an airfoil of said turbine section.

18. The gas turbine engine as recited in claim 16, wherein said component is a blade outer air seal (BOAS).

19. The gas turbine engine as recited in claim 16, wherein said first wall is part of a platform of said component.

20. The gas turbine engine as recited in claim 17, wherein said component includes a first rib and a second, opposed rib that each extend between said first wall and said second wall to bound said cavity flow path, and said at least one curved turbulator is defined between said first rib and said second rib.

* * * * *